United States Patent [19]

Linhart et al.

[11] 4,447,489

[45] May 8, 1984

[54] FILAMENT YARNS OF MULTICOMPONENT FIBERS AND UTILIZATION THEREFOR IN TEXTILE FABRICS

[75] Inventors: Heinz Linhart, Erlenbach; Reiner Modtler; Eberhard Kratzsch, both of Wuppertal, all of Fed. Rep. of Germany

[73] Assignee: Akzona Incorporated, Asheville, N.C.

[21] Appl. No.: 304,907

[22] Filed: Sep. 23, 1981

[30] Foreign Application Priority Data

Sep. 23, 1980 [DE] Fed. Rep. of Germany ..... 3035862

[51] Int. Cl.[3] ..... D03D 3/00

[52] U.S. Cl. ..... 428/225; 28/159; 57/247; 57/248; 57/284; 156/85; 156/155; 156/296; 156/308.4; 264/147; 264/171; 428/228; 428/253; 428/257; 428/374

[58] Field of Search ..... 264/171, 147; 428/373, 428/374, 376, 398, 225, 257, 228; 57/247, 248, 251, 286, 284; 28/159; 156/85, 155, 308.4, 296

[56] References Cited

U.S. PATENT DOCUMENTS 4,239,720 12/1980 Gerlach et al. ..... 264/147

4,364,983 12/1982 Brücher et al. ..... 428/374

FOREIGN PATENT DOCUMENTS 2043731 10/1980 United Kingdom .

*Primary Examiner*—James J. Bell

*Attorney, Agent, or Firm*—Antonelli, Terry & Wands

[57] ABSTRACT

Filament yarns composed of multicomponent fibers of the matrix/segment type are produced and processed into textile fabrics by false-twist texturing the multicomponent fibres made up of segments of varying deniers to cause softening the matrix to bond the filaments together over short, medium or longer sections of the yarn. After conversion of the yarns into fabrics, the fabrics are subjected to a shrinking treatment. The fabrics so treated have a reduced tendency to crease or wrinkle, better crease recovery and better dyeing properties. The denier of the lower denier segments should be finer than 0.6 dtex and the denier of the high denier segments should bg at least 1 dtex; the weight ratio of low to high denier segments in the yarn ranges from about 25:75 to about 75:25. The matrix is preferably made of polyamide 6 while the segments are polyethylene terephthalate. The cross-sectional shapes of the fibers may e.g. resemble a toothwheel with fine peripheral segments and a coarser core, combinations of three-toothed wheels with 12 or 6 peripheral teeth or similar combinations of orange-shaped cross-sections such as 3 and 6 "slices".

22 Claims, 1 Drawing Figure

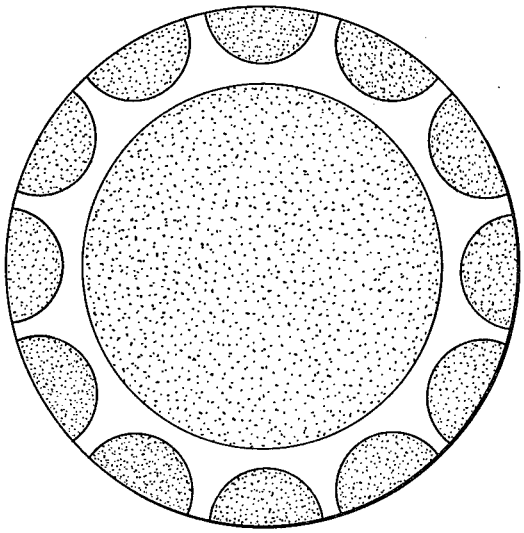

FILAMENT YARNS OF MULTICOMPONENT FIBERS AND UTILIZATION THEREFOR IN TEXTILE FABRICS

This invention relates to a process for the production of filament yarns of multicomponent fibers of the matrix/segment type, to the resulting filament yarns and to a process for the further processing of the yarns to provide textile fabrics, in particular woven and knit goods as well as the resulting textile fabrics.

Multicomponent fibers of the matrix/segment type have been known for some time. In French Pat. No. 1,325,529 fibers of this type of varied cross-sections are described. The characteristic feature of matrix/segment threads is that one component i.e. the so-called segments, are partly or wholly embedded in the other component, that is the matrix. The cited French patent furthermore teaches that e.g. by treatment in acetone for 5 minutes, followed by repeated passage over a sharp blade, the multicomponent fiber is wholly ore partly divided into individual components. It is furthermore possible to separate the components by treating the multicomponent fiber with a solvent that will dissolve one of the components.

However, the processes described in the French patent present certain drawbacks. On the one hand, dissolving of one of the components in a solvent results in the loss of useful and valuable material or the dissolved material must be recovered in a complex process; on the other hand, the process of dissolving is time-consuming. Finally, the characteristics of the remaining components are impaired by treatment with the solvent. The mechanical processes described therein aimed at separating the components produce only incomplete splitting or fibrillation into individual components and also cause degradation of the yarn.

German Patent Disclosure No. 2,809,346 (which corresponds to U.S. Pat. No. 4,239,720) describes a process whereby the multicomponent fibers are treated with special organic solvents in which the individual components will not dissolve, but in which the multicomponent fibers exhibit a favorable shrinkage behavior resulting in extremely rapid and practically total splitting into matrix and segment components. The fiber structures described therein are distinguished specifically by a natural hand very much like that of silk.

German Patent Disclosure No. 2,908,101 (which corresponds to British Patent Specification No. 2,043,731) describes a process whereby the multicomponent fibers of the matrix/segment type are subjected to a special falsetwisting treatment so that all or part of the individual components in the filament bundle are fused entirely or partly through the cross-section at irregular intervals. The threads mentioned in this German patent likewise exhibit a silk-like character and when used as warp ends need no preliminary sizing and/or twisting.

The silk-like character of the yarn and of the textile fabrics is generated essentially by the presence of segment fibers of a low denier and their special alignment in the fabric. The denier of segment fibers is in most instances less than 0.6 dtex. Whereas, on the one hand, the low denier is a great advantage especially in terms of wear comfort, it entails, on the other hand, the drawback that the textile fabrics have much more of a wrinkling tendency and also have a crease recovery that leaves, in many cases, much to be desired. Moreover, textile fabrics made from the above-mentioned filaments or yarns are subject to dyeing difficulties. Generally, the dyings turn out lighter for the same amount of dyestuff as otherwise used in dyeing textile fabrics, e.g. when dyeing fabrics composed of conventional polyester yarns. It is also difficult to obtain deep dyeings of sufficient fastness even in the presence of larger quantities of dyestuff. There exists therefore a need to improve the processes for the production of filaments and yarns of the multicomponent fiber type and their characteristics as well as to obtain textile fabrics which do not present the above-cited drawbacks.

The objective of the invention is therefore to make available a suitable, economical process for producing yarns leading to textile fabrics having a reduced wrinkling tendency and an improved crease recovery. The objective of the invention is, furthermore, to make yarns and textile fabrics of multicomponent fibers of the matrix/segment type having a better dye affinity, requiring less dyestuff during dyeing than heretofore known textile products composed of split multicomponent fibers and which in addition can be obtained in deep dyeings. This objective is met by a process for the production of filament yarns of multicomponent fibers of the matrix/segment type that under certain conditions can be further processed into a textile fabric, characterized in that multicomponent fibers, each comprising segments of varying deniers within a matrix wherein the ratio of low denier segments to high denier segments is between about 1:1.6 and 1:30, and the weight ratio of the low denier segments to the high denier segments in the yarn is between about 25:75 and 75:25, are textured by falsetwisting in conjunction with a setting temperature which is at least equal to the melting point of the matrix component, whereby the multicomponent fibers are fused together by softening of the matrix components in spots, zones or over nearly the entire length, within the entire or part of the cross section of the yarn and the multicomponent fibers are also wholly or partly split, i.e. the segment components are separated from the matrix components. These yarns may, after processing into a textile fabric, be subjected to a shrinkage treatment. The denier of the low denier segments should be not more than 0.6 dtex and the denier of the high denier segments should be at least 1 dtex.

In accordance with this invention use can be made of multicomponent fibers having segments of varying deniers and varying profiles. A setting temperature of 190° to 230° C. is preferably used. Multicomponent fibers having peripheral segments of varying deniers may be used, but multicomponents fibers having low denier peripheral segments and high denier segments which are wholly embedded in the matrix are also suitable. The matrix component of the multicomponent fibers is expediently a polyamide and the segment component is a polyester; preferably polyethylene terepthalate is the polyester segment component and polyamide 6 is the polyamide matrix component. Methylene chloride is eminently suitable for use in the shrinkage treatment after the textured yarns have been formed into fabrics. The shrinkage treatment may also be applied in water in conjunction with the action of mechanical forces; the shrinkage treatment may be simultaneously combined with a drying or a scouring process. Shrinkage can also be accomplished by tumbling the yarns in hot air. The matrix component of the multicomponent fibers is expediently between 5 to 45%, preferably between 7.5 and 20% by weight of the total fiber. This invention is furthermore directed to the filament yarns formed of the wholly or partly split multicomponent fibers of the matrix/segment type, characterized in that the multicomponent fibers comprise segments of varying deniers, wherein the ratio of low denier segments to high denier segments is between 1:1.6 and 1:30 and the weight ratio of low denier to the high denier segments in the yarn between 25:75 and 75:25, individual components in the filament yarn bundle being wholly or partly bonded at irregular intervals over shorter or longer sections through the yarn cross-section. Another embodiment of the invention is directed to filament yarns of wholly or partly split multicomponent fibers of the matrix/segment type, characterized in that the multicomponent fibers comprise segments of varying denier, wherein the ratio of the low denier segments to the high denier segments ranges between about 1:1.6 and 1:30, the weight ratio of low denier segments to high denier segments in the yarn ranges between about 25:75 and 75:25 and in that individual components in the filament bundle are wholly or partly bonded over nearly the entire length of the yarn.

In an especially advantageous embodiment the filament yarns of the invention are characterized by multicomponent fibers having at least 10 low denier peripheral segments and a high denier segment entirely surrounded by the matrix wherein the ratio of low denier segments to the high denier segment ranges between about 1:25 to 1:30. This invention is furthermore directed to textile fabrics such as woven and knitted fabric or the like, formed of the above-mentioned filament yarns. The filament yarns in the textile fabrics comprise preferably low denier segment fibers of a denier lower than 0.6 dtex and higher denier segment fibers of a denier of at least 1 dtex. The number of bonding points in the yarns is advantageously between 3 and 80 per meter. To obtain multicomponent fibers of the matrix/segment type containing segments of varying denier in the required denier ratio, use can be made of a device as described in German OS No. 2,803,136 (which corresponds to U.S. application Ser. No. 006,491 filed Jan. 25, 1979). By combining multicomponent fibers exhibiting cross-sections as described in FIG. 1 and FIG. 2 of this patent disclosure, it is possible to obtain a multicomponent fiber blend possessing the desired segment ratios. It is also possible to have combinations of cross-sections as per FIG. 1 and FIG. 6 of German OS No. 2,803,136, whereby both differences in segment denier and differences in profile can be obtained. Cross-sections with rounded-off segments, as illustrated in FIGS. 1 to 3 of this German disclosure are also identified as gearwheel profile, and FIG. 1 and FIG. 2 represent so-called three-toothed and six-toothed gearwheel profiles. The cross-section shown in FIG. 6 is often referred to as orange-segment profile.

In an especially advantageous embodiment of the invention, a cross-section as illustrated in FIG. 3 of German OS No. 2,803,136 is modified so that at least 10, preferably 12 peripheral segments and 1 core segment are present. This embodiment of the invention is shown in cross-section in the accompanying sole FIGURE of the drawing wherein a multicomponent filament has 12 peripheral segments and a single core segment.

Suitable adjustment of the spinning and drawing conditions of the fiber will lead to a yarn which after processing possesses low denier segments, e.g. within the range of about 0.08 to 0.1 dtex and a high denier segment of about 2.2 to 2.6 dtex. A useful yarn comprising these multicomponent fibers may contain e.g. 15 fibers and thus includes 180 fine and 15 heavier segments (See Table I, Ex. 3).

Spinnerets having the desired cross-sections can be mounted on a common spinning plate so that one spinning point will simultaneously produce the required number of multicomponent fibers for the filament yarn. The multicomponent fibers which possess the required segment structure in accordance with the invention are then drawn and/or subjected to a falsetwisting treatment in conjunction with a setting temperature which is at least equal to the melting temperature of the matrix component. Details of this type of falsetwisting treatment are given in DE OS No. 2,908,101 (and British Patent Specification No. 2,043,731) to which reference is specifically made for incorporation thereof.

By variation of the falsetwist-crimping parameters, fusion of the segments can be controlled within wide limits. Depending on conditions, e.g. by variation of the contact time on the first heating unit, only a few punctiform i.e. point-like fusions or else fusions involving extensive zones can be obtained. Under more intensive conditions it is possible to have fusion over virtually the entire length of the yarn. In terms of the cross-section, the fusions may involve individual segments, yet the fusion may also extend over the entire cross-section of the yarn. The fusion intensity can also be varied by selection of the matrix component and the proportion thereof in the multicomponent fiber. Conventional devices, e.g. a Barmag Type FK6C unit, can be used for falsetwist-texturing.

As a result of the shrinkage treatment, which under practical conditions is applied particularly after processing to a textile fabric, a part of the fusion points is dissolved so that individual components are subjected to drastic splitting or fibrillation, which during falsetwist-texturing was scarcely present or if so only to a limited extent.

The yarn shrinkage treatment which is preferably performed after processing to form textile fabric is advantageously applied according to the process described in German OS 2,809,346. Methylene chloride, the solvent cited in this patent is eminently suitable for this shrinkage treatment. As regards fibrillation and splitting of the multicomponent fibers into segments, reference is specifically made to the disclosure in patent disclosure No. 2,809,346 and the corresponding U.S Pat. No. 4,239,720.

In numerous cases it is possible to carry out—instead of the shrinkage treatment described in the cited patent disclosures—a shrinkage treatment in water with simultaneous use of mechanical forces. This suggests, in particular, scouring, a process required during the production of the textile fabric. It is furthermore possible to combine the shrinkage process with a dyeing phase in e.g. an aqueous bath. It was particularly surprising to find that the invention made it possible to produce, in an especially advantageous manner, yarns and textile fabrics having excellent properties.

The falsetwist-textured yarns exhibit excellent yarn cohesion and can be further processed without major problems. The yarns can be fed and taken-up at high speeds without the segments causing yarn breakage or separation of part of the segments. An especially favorable feature is that the yarns can be warped directly without need for sizing or twisting. This is not only advantageous because it does away with the sizing process, but also because it eliminates a polluting processing phase.

After processing to a textile fabric and development of the shrinkage, the yarns acquire considerable bulk and hence excellent covering power. The fine segments which produce a fine, soft loop pile at the surface of the textile fabric impart an especially pleasing hand. Moreover, they act as spacer between skin and textile fabric so that the garment feels pleasant to the skin but also allows sufficient air to circulate on the skin which especially in the presence of perspiration enhances wearing comfort.

Texturing by the falsetwist-texturing method presents no difficulties. Hence, e.g. on the texturing unit and on the so-called hot plate there are no deposits which might prove detrimental. As a result of the presence of segments of varying deniers, the segments in the falsetwist-textured filament yarns exhibit variations in relaxation and shrinkage behavior. This has an especially favorable effect on the hand and bulk of the textile fabric. The yarns of the invention are suitable for the production of conventional textile fabrics such as woven and loop goods. Also the yarns can be processed on conventional looms and knitting machines without difficulties.

The textile fabrics of the invention are distinguished by improved crease or wrinkling behavior, especially a reduced crease tendency and better crease recovery for the same optical dye depth, the quantity of dyestuff compared with that required for dyeing of textiles from conventional matrix/segment yarns can be reduced by at least 10% and frequently by much more. Fastnesses are satisfactory. Examples of some of the configurations of the filament yarns according to the invention are listed in the following table.

| Ex. | Total | No. of Ends | Low Denier Segments dtex | High Denier Segments dtex | Remarks |
|---|---|---|---|---|---|
| 1 | 50 | 15 | 0.5 | 1.0 | 8 fil. 6-segment orange cross section (cs)<br>7 fil. 3-segment orange |
| 2 | 100 | 15 | 0.5 | 2.0 | 8 fil. 12-segment orange cross section (cs)<br>7 fil. 3-segment orange cross section |
| 3 | 50 | 15 | 0.08 | 2.2 | 12-teeth gearwheel with core segment |
| 4 | 100 | 15 | 0.15 | 4.4 | 12-teeth gearwheel with core segment |
| 5 | 100 | 15 | 0.15 and 0.5 | 2.1 and 4.4 | 5 fil. 12-segment orange (cs)<br>5 fil. 12-teeth gearwheel with core segment<br>5 fil. 3-segment orange (cs) |

We claim:

1. A process for the production of filament yarns of multicomponent fibers of the matrix/segment type which comprises falsetwist-texturing a plurality of multicomponent fibers containing one component in the form of segments having varying deniers with a matrix component to produce a yarn, wherein the ratio of low denier segments to high denier segments is between about 1:1.6 and 1:30 and the weight ratio of low denier segments to high denier segments in the yarn is between about 25:75 and 75:25, at a setting temperature which is at least equal to the melting temperature of the matrix component, whereby the fibers are fused together by softening of matrix component in spots, zones or over nearly the entire length involving the entire or part of the cross-section of the yarn.

2. A process according to claim 1, wherein said multicomponent fibers contain segments of varying deniers and varying profiles.

3. A process according to claims 1 to 2, wherein the setting temperature is from about 190° to 230° C.

4. A process according to claim 1 or claim 2, wherein the multicomponent fibers have peripheral segments of varying deniers.

5. A process according to claim 1 or claim 2, wherein the multicomponent fibers have low denier peripheral segments and a high denier segment which are entirely surrounded by the matrix.

6. A process according to claim 1 or claim 2, wherein the matrix component is a polyamide and the segment component is a polyester.

7. A process according to claim 6, wherein the polyester is polyethylene terephthalate and the polyamide is polyamide 6.

8. A process for forming a textile material from the yarn provided according to claim 1, wherein the yarn is processed into a textile material and the textile material is then subjected to a shrinkage treatment.

9. A process according to claim 8, wherein the shrinkage treatment is carried out in a methylene chloride containing bath.

10. A process according to claim 8, wherein the shrinkage treatment is applied in water in combination with the action of mechanical forces.

11. A process according to claim 10, wherein the shrinkage treatment is simultaneously combined with dyeing.

12. A process according to claim 10, wherein the shrinkage treatment is simultaneously combined with scouring and washing.

13. A process according to claim 8, wherein the shrinkage treatment is effected by tumbling in hot air.

14. A process according to claim 1 or claim 8, wherein the multicomponent fibers have a ratio of matrix to segments of 5:95 to 45:55.

15. A process according to claim 14, wherein the multicomponent fibers have a ratio of matrix to segments of 7.5:92.5 to 20:80.

16. A process according to claim 1, wherein said multicomponent fibers are also wholly or partly split whereby the segment components are separated from the matrix component during said false twist-texturing treatment.

17. A filament yarn of fully or partly split multicomponent fibers of the matrix/segment type, which comprises a plurality of multicomponent falsetwist textured fibers containing segments of varying deniers within a matrix wherein the ratio of low denier segments to high denier segments is between about 1:1.6 and 1:30, and the weight ratio of low denier segments to high denier segments in the yarn is between about 25:75 and 75:25, and the individual components of the fibers are wholly or partly bonded in spots or zones at irregular intervals in the yarn bundle through the yarn cross-section by fused bonding points.

18. A filament yarn of fully or partly split multicomponent fibers of the matrix/segment type, which comprises a plurality of multicomponent falsetwist textured fibers containing segments of varying deniers within a matrix wherein the ratio of low denier segments to high denier segments is between about 1:1.6 and 1:30, and the weight ratio of low denier segments to high denier segments in the yarn is between about 25:75 and 75:25, and the individual components of the fibers are wholly or partly bonded over nearly the entire length of the yarn.

19. A filament yarn according to claim 17 or claim 18, wherein the multicomponent fibers have at least 10 low denier peripheral segments and a high denier segment entirely surrounded by the matrix and wherein the ratio of low denier segments to high denier segments ranges between about 1:25 and 1:30.

20. A textile fabric formed of the yarn according to claim 17 or claim 18.

21. A textile fabric according to claim 19, wherein the low denier segment fibers have a denier less than 0.6 dtex and the high denier segment fibers have a denier of at least 1 dtex.

22. A textile fabric according to claim 21, wherein the number of bonding points in the yarns forming the fabric is between 3 and 80 per meter.

* * * * *